US006554054B2

(12) United States Patent
Noble

(10) Patent No.: US 6,554,054 B2
(45) Date of Patent: Apr. 29, 2003

(54) METHOD AND APPARATUS FOR CENTRIFUGAL CASTING

(76) Inventor: Charles H. Noble, 3610 Vicksburg Dr., Birmingham, AL (US) 35213

( * ) Notice: Subject to any disclaimer, the term of this patent is extended or adjusted under 35 U.S.C. 154(b) by 0 days.

(21) Appl. No.: 09/753,676

(22) Filed: Jan. 4, 2001

(65) Prior Publication Data

US 2002/0121356 A1 Sep. 5, 2002

(51) Int. Cl.[7] ..... B22D 13/10
(52) U.S. Cl. ..... 164/114; 164/298; 164/178
(58) Field of Search ..... 164/114, 115, 164/116, 117, 118, 298, 300, 301, 33, 34, 138, 37, 175, 178, 164

(56) References Cited

U.S. PATENT DOCUMENTS

| | | | | |
|---|---|---|---|---|
| 1,581,635 A | | 4/1926 | Henry et al. | |
| 1,697,889 A | * | 1/1929 | Uhrig | 164/118 |
| 1,963,147 A | * | 6/1934 | Russel et al. | 164/118 |
| 1,963,149 A | * | 6/1934 | Russel et al. | 164/118 |
| 2,731,690 A | | 1/1956 | Coupland, Jr. et al. | 22/200.5 |
| 3,056,692 A | | 10/1962 | Kitada | 117/5.3 |
| 3,110,944 A | | 11/1963 | Phelps | 22/192 |
| 3,437,131 A | | 4/1969 | Ornitz | 164/298 |
| 3,944,193 A | | 3/1976 | Imai et al. | 266/1 R |
| 4,150,709 A | | 4/1979 | Brugger | 164/72 |
| 4,240,492 A | | 12/1980 | Edwards et al. | 164/34 |
| 4,260,009 A | | 4/1981 | Noble | 164/270 |
| RE31,482 E | | 1/1984 | Noble | 164/114 |
| 4,628,984 A | | 12/1986 | Noble | 164/33 |
| 4,632,168 A | | 12/1986 | Noble | 164/33 |

* cited by examiner

*Primary Examiner*—M. Alexandra Elve
*Assistant Examiner*—Len Tran
(74) *Attorney, Agent, or Firm*—Roylance, Abrams, Berdo & Goodman, L.L.P.

(57) ABSTRACT

A method and apparatus for use in centrifugal casting of metal articles forms a compacted lining of a particulate refractory material on an inner surface of the mold. An amount of a dry binderless particulate refractory material is dispensed on the inner surface of a rotating mold body to form a centrifugally densified layer. A plowing tool is brought into contact with a layer of refractory material while continuously rotating the mold body to plow and compact the layer of particles. The tool is oriented at an angle with respect to the direction of travel of the layer of particles to penetrate the layer and compact the particles toward the inner surface of the mold body. The combination of the centrifugal force and the mechanical compaction of the particles results in a dense, air impervious, compacted mold lining having interlocked particles and voids between the particles that are not interconnected with an adjacent void. The mold is formed with at least one air inlet and at least one air outlet communicating with an inner surface of the mold. A porous lining is formed on the inner surface of the mold in communication with the air inlet and the air outlet. Rotation of the mold draws air through the inlet and the porous lining and out through the outlet to cool the lining during casting.

38 Claims, 5 Drawing Sheets

METHOD AND APPARATUS FOR CENTRIFUGAL CASTING

FIELD OF THE INVENTION

The present invention is directed to a method and apparatus for centrifugal casting of metal articles. More particularly, the invention is directed to a method and apparatus for forming a mold lining of a refractory material in the centrifugal casting of metal articles.

BACKGROUND OF THE INVENTION

Centrifugal casting is a common method used for casting tubular metal articles including engine cylinder liners. The centrifugal casting apparatus is typically a cylindrical shaped metal mold that is rotated about the longitudinal axis at sufficient speed to distribute the molten metal along the inner surface of the mold. The molds are generally made of metal and have the inner mold surface covered with a lining material to protect the mold from damage and overheating by contact with molten metal. The lining material also is provided to prevent the molded article from bonding to the mold surface.

One method for applying a lining to centrifugal casting molds applies a slurry of a fine particulate refractory material. The refractory materials are typically zircon powder or silica powder and a binder such as bentonite clay. Applying a slurry of a refractory material to a mold surface has exhibited some success. However, a disadvantage of this method is that the mold requires adequate venting to vent water vapor produced during the casting process.

Other methods of forming a mold lining use a binder material, such as a resin, to bond the particles together and to bond the material to the surface of the mold. These methods can be difficult to apply and form a uniform surface. In addition, the application of a lining material using a binder can be expensive and produce gaseous products by the heat from the molten metal during the casting of the metal article.

Another method for forming a lining in a centrifugal casting mold is disclosed in U.S. Pat. Nos. 4,124,056 and 4,260,009 to Noble. The lining material disclosed in this patent is a dry, binderless particulate refractory material that is applied to the surface of the rotating mold. As disclosed in this patent, the refractory material is introduced into the rotating mold as a dry powder without the use of binders or slurries. The method of this patent is primarily directed to forming a straight or contoured surface on the lining for molding cylindrical articles. The refractory material is subjected to centrifugal force to form the mold lining. A blade removes the excess amount of the mold lining. However, it has been found that the process of this patent does not form a sufficiently uniform or hard molding surface and that imperfections can form in the molded article, because the refractory grains are not compacted and densified.

To overcome the disadvantages of the process of the above-noted U.S. patents, a vibration inducting device was coupled to the mold to vibrate the mold as the mold rotates. The method of vibrating the mold while the refractory material is applied to the inner surface of the rotating mold is disclosed in U.S. Pat. No. 4,632,168 to Noble. However, repeated trials have found that vibrating the mold does not produce a satisfactory lining for producing a molded article because the angular grains of milled refractory are held in place by centrifugal force, and will not move and pack when vibrated as would round grains. The resulting lining is not of a uniform density and has soft spots that result in imperfections in the molded article.

U.S. Pat. No. 4,632,168 to Noble discloses a molding process where a porous primary layer and a facing layer forms a vented particulate refractory lining in the mold to vent air pressure through the primary layer caused by the elevated temperatures when the molten metal contacts the facing layer.

The prior methods of forming a lining from a refractory material in a centrifugal casting mold have met with a limited success. Linings formed from refractory materials that include a binder or are applied as a slurry require adequate venting of the mold to allow the escape of water vapor and gaseous components of the binder material. The prior method of forming a lining from a dry, binderless particulate refractory material typically produce a lining that is not of a uniform density throughout the lining that results in soft spots in the lining. These soft spots do not enable the production of a molded article having a uniform surface since the soft area in the lining is typically mirrored in the molded article. Accordingly, there is a continuing need in the industry for an improved method and apparatus for forming a lining material in a centrifugal casting mold.

SUMMARY OF THE INVENTION

The present invention is directed to a method and apparatus for centrifugally casting metal articles. The invention is further directed to a method and apparatus for forming a mold lining in a centrifugal casting mold.

Accordingly, a primary object of the invention is to provide a method and apparatus for forming a mold lining from a dry, binderless particulate refractory material without the use of binders or adhesives.

Another object of the invention is to provide a method and apparatus for forming a lining from a dry, binderless particulate refractory material having a smooth molding surface without imperfections that would otherwise be mirrored in the molded article.

A further object of the invention is to provide a method and apparatus for forming a mold lining in a centrifugal casting mold where the lining is compacted and densified to avoid the formation of soft spots in the mold lining.

Still another object of the invention is to provide a method and apparatus for forming a molding lining in a centrifugal casting mold from particles of a dry, binderless particulate refractory material where the particles are compacted by centrifugal force and mechanical force to form a densified mold surface.

Another object of the invention is to provide a method and apparatus for forming a mold lining in a centrifugal casting mold from compacted particles of a dry, binderless particulate refractory material where the lining is substantially impervious to air and molten metal.

Another object of the invention is to provide a method and apparatus for forming a mold lining in a centrifugal casting mold from particles of a dry, binderless particulate refractory material where the particles are sufficiently compacted and densified so that the voids between the particles are not interconnected with the voids between adjacent particles.

Another object of the invention is to provide a method and apparatus for forming a mold lining from particles of a dry, binderless refractory material where the particles are subjected to centrifugal force and mechanical redistribution and compaction to expel air between the particles of the lining.

Still another object of the invention is to provide a method and apparatus for mechanically compacting and redistributing particles of a dry, binderless refractory material on the inner surface of a rotating centrifugal casting mold to form a mold lining of interlocked particles.

Another object of the invention is to provide a method and apparatus for forming an air impervious layer of particles of a dry, binderless refractory material in a centrifugal casting mold where the particles are interlocked to form a hard mold lining.

Another object of the invention is to provide a method and apparatus for forming a lining in a centrifugal casting mold by mechanically redistributing and compacting particles of a dry, binderless particulate refractory material while subjecting the particles to the force of inertia of rotation combined with centrifugal force in a rotating mold.

A further object of the invention is to provide a mold lining in a centrifugal casting mold by dispersing particles of a dry, binderless refractory material on the inner surface of a rotating mold and contacting the particles with a tool to redistribute and compact the particles on the inner surface of the mold.

Another object of the invention is to provide a method and apparatus for venting a mold lining and removing heat from a centrifugal mold by using mold vents placed at different diameters on the mold to create air flow through a porous refractory material. The vents include an inlet and an outlet that are radially spaced apart with respect to an axis of rotation of the mold.

These and other objects of the invention are basically attained by providing an apparatus for producing molded articles by centrifugal casting. The apparatus comprises a centrifugal casting mold having an inner mold surface with a longitudinal length and a generally open axial end for receiving a molten metal, a mold-rotating device for rotating the centrifugal casting mold, a dispensing device for introducing a predetermined amount of particles of a dry, binderless milled refractory lining material on the inner mold surface of the centrifugal casting mold substantially uniformly along the longitudinal length of the mold to form a layer of the lining material on the inner mold surface, a plowing device for contacting the layer of the lining material while rotating the mold and redistributing, compacting, and densifying the refractory material in the mold to form a compacted and substantially air impervious mold lining of interlocking particles of the refractory material, and a molten metal supply device for supplying molten metal onto the mold lining in the mold.

The objects of the invention are further attained by providing a method for the centrifugal casting of metal articles. The method comprises the steps of providing a rotary mold assembly having an elongated cylindrical mold with an inner mold surface and a generally open axial end. A predetermined amount of particles of a dry, binderless milled refractory material is introduced onto the inner mold surface while continuously rotating the cylindrical mold at a sufficient speed while distributing the refractory material along the inner mold surface and forming a layer of the refractory material on the inner mold surface. The layer of the refractory material is contacted with a plowing device while continuously rotating the cylindrical mold to physically redistribute, compact and densify the particles of the layer of the refractory material and form a substantially air impervious mold lining. The mold is rotated at a speed sufficient to cast a molten metal against the inner surface of the mold, and introducing a molten metal onto the mold lining and molding the metal.

These and other objects, advantages and salient features of the invention will become apparent to one skilled in the art in view of the following detailed description of the invention annexed drawings which form a part of this original disclosure.

BRIEF DESCRIPTION OF THE DRAWINGS

The following is a brief description of the drawings, in which.

DETAILED DESCRIPTION OF THE INVENTION

The present invention is directed to a method and apparatus for the centrifugal casting of metal articles. In particular, the invention relates to a method and apparatus for forming a lining on the inner surface of a centrifugal casting mold.

The method of the invention basically applies an amount of a dry, binderless particulate milled refractory material into a rotating mold body where the refractory material is dispersed along the inner surface of the mold body to form an initial layer. The layer is a loosely packed layer formed by centrifugal force in the rotating mold body. The layer of the refractory material is then subjected to a mechanical redistribution of the particles while the mold is continuously rotated in a manner to compact the particles and to expel air from the spaces between the particles to form a firm and substantially air impervious lining. A plowing tool penetrates the initial layer of the refractory material while the mold body rotates to redistribute and compact the particles substantially along the entire length of the mold body. The plowing tool is moved toward the inner surface of the rotating mold to penetrate the loose layer of refractory particles to a desired depth. The plowing tool has a working surface to plow and compact the particles and form a compacted layer.

The plowing tool is gradually moved away from the inner surface of the mold, which gradually increases the thickness of the compacted layer of particles. The resulting lining is formed from a matrix of interlocking particles of refractory material where the voids between the particles are not interconnected with an adjacent void. The voids between the particles are sealed by the interlocking particles to form a stable, air impervious and self-supporting mold lining held in place by atmospheric pressure and centrifugal force. The air impervious matrix surrounding the voids substantially prevents air from entering the voids, which further stabilizes the matrix. When the mold is rotating to generate 100 gravities, zircon flour is held in place with an additional 16 pounds of centrifugal force per cubic inch.

Figure 1:
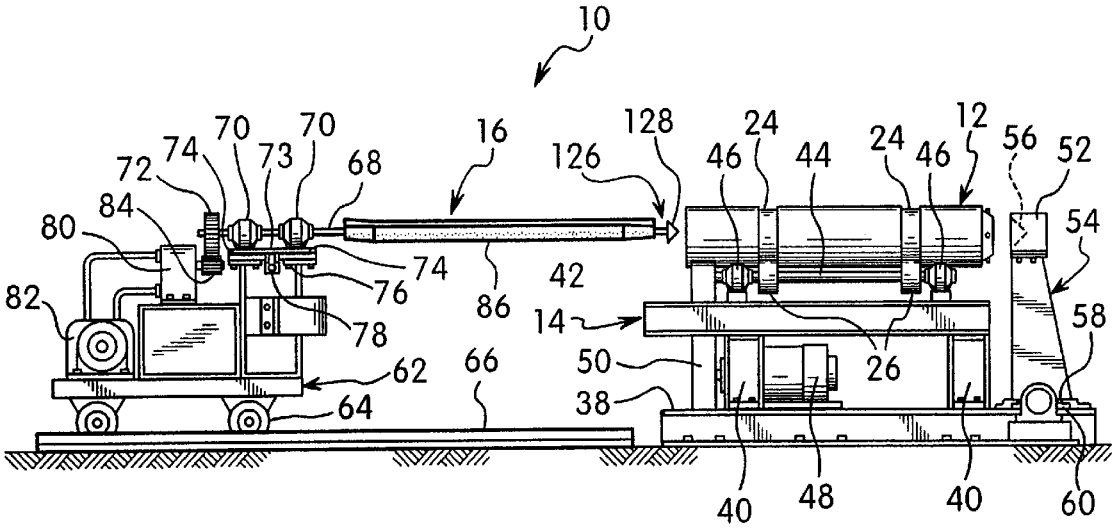
FIG. 1 is a side elevational view of a centrifugal casting molding assembly in one embodiment of the invention.

Referring to FIG. 1, the mold assembly 10 in one embodiment of the invention includes mold body 12, a rotating and supporting device 14 and a device 16 for dispensing a refractory material and shaping the refractory material in the mold body 12. It will be understood that the mold body 12 and the rotating and supporting device 14 are examples of suitable structures for practicing the invention and that other mold structures can be used. It is also understood that the invention can be applied to both horizontal centrifugal casting, as illustrated in FIG. 1, and vertical centrifugal casting.

Figure 2:
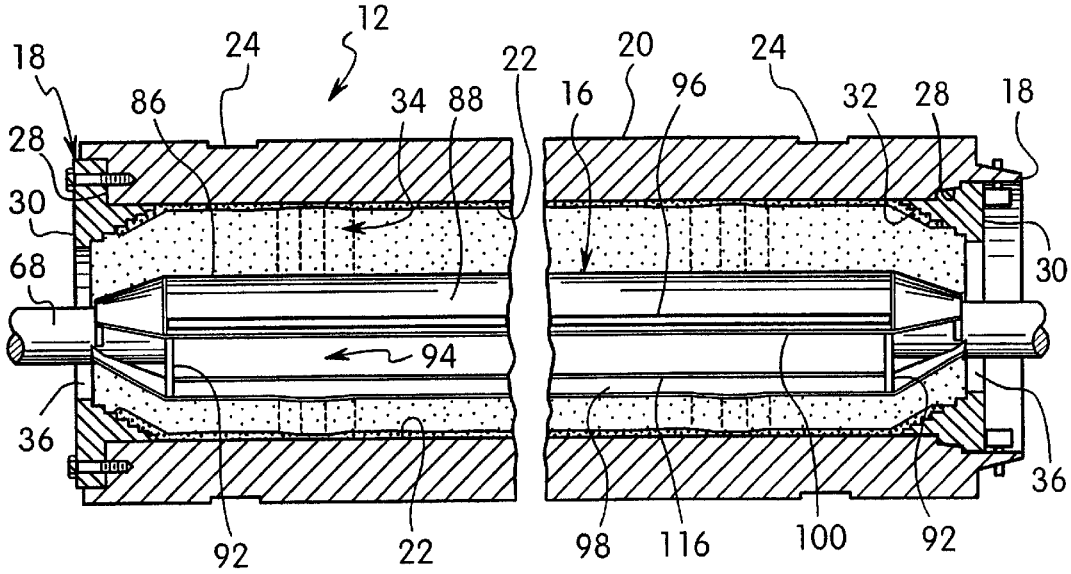
FIG. 2 is a cross-sectional side view of the centrifugal mold and dispensing trough for a refractory material in one embodiment of the invention.

Mold body 12 has a shape suitable for centrifugal casting of metal articles as known in the art. Typically, the centrifugal casting molds have an external shape that is suitable for engaging the rotating device and have an internal shape of a constant diameter bore. In one embodiment of the invention as shown in FIGS. 1 and 2, mold body 12 has a generally cylindrical shape with open axial ends 18, a substantially cylindrical outer surface 20, and a substantially cylindrical inner surface 22. Outer surface 20 is provided with two annular grooves 24 that engage drive rollers 26 for rotating mold body 12 as discussed hereinafter in greater detail.

Inner surface 22 of mold body 12 has a substantially smooth face. In the illustrated embodiment, mold body 12 is shaped to contain a lining for molding a length of pipe or cylinder sleeve for an internal combustion engine having a substantially cylindrical shape. It will be understood that the mold body 12 is intended to be illustrative of the invention and that the mold body 12 can contain a lining of any desired shape that is capable of being molded by centrifugal casting methods.

Each open axial end 18 of mold body 12 has an annular recess 28 facing outwardly in an axial direction for receiving an annular end ring 30. Typically, each annular end ring 30 is attached to mold body 12 by screws, bolts or other suitable fasteners as known in the art. In the embodiment shown, each end ring 30 has an inner face 32 for forming the axial end of a mold cavity 34 for forming the molded article. In further embodiments, inner face 32 can have a shape suitable for forming the desired shape of the molded article. Each annular end ring 30 is provided with a central opening 36 that is dimensioned for receiving the refractory material-dispensing device 16.

Supporting device 14 in a preferred embodiment of the invention is a stationary device having a base 38 and supporting legs 40 attached to a frame 42. Drive rollers 26 are coupled to shaft 44 that is supported on bearings 46 for supporting the mold body 12. Two drive rollers 26 are provided on each side of supporting device 14 to support mold body 12. Shaft 44 is connected to a drive motor 48 by a belt 50 for rotating drive rollers 26. As shown in FIG. 1, annular grooves 24 in mold body 12 are dimensioned to couple with drive rollers 26 to rotate mold body 12 at a desired speed.

Referring to FIG. 1, supporting device 14 includes a stationary bearing 52 mounted on a pedestal 54 that is positioned at the axial end of mold body 12. Stationary bearing 52 has a recess 56 facing mold body 12 to complement an axial end of dispensing device 16 as discussed hereinafter in detail. Pedestal 54 has a base 58 that is slidably mounted in a horizontal key slot 60 that extends at right angles to the longitudinal axis of mold body 12. In this manner, pedestal 54 and stationary bearing 52 can be moved along key slot 60 from an active position shown in FIG. 1 where stationary bearing 52 is coaxial with mold body 12 to an inactive position to the side of mold body 12. A suitable drive and control device can be included to move pedestal along key slot 60.

Dispensing device 16 is mounted on a movable carriage 62 having wheels 64. Carriage 62 rolls along a track 66 for inserting and positioning dispensing device 16 with mold body 12. Dispensing device 16 includes an axially extending trunion 68 with bearings 70 coupled to a drive gear 72. Bearings 70 are supported by slide member 73 that is slidably mounted in track 74 on a base 76. An adjustment screw 78 is coupled to base 76 and slide member 73 to selectively adjust the lateral position of dispensing device 16 with respect to carriage 62. Base 76 can include a vertical adjustment device to selectively adjust dispensing device 16. A hydraulic motor 80 driven by a pump 82 is coupled to gear 84. Gear 84 is operatively coupled to drive gear 72 for rotating drive gear 72 and dispensing device 16 about its longitudinal axis. Movable carriage 62, and the drive assembly for dispensing device 16 in one embodiment, is substantially the same as the device disclosed in U.S. Pat. No. 4,124,056 to Noble and is hereby incorporated by reference in its entirety.

Referring to FIG. 1, dispensing device 16 is mounted on trunion 68. For purposes of illustration, dispensing device 16 has a substantially cylindrical shape with a longitudinal axis and tapered axial ends. As shown in FIG. 2, the axial ends conform to the inner surface of mold body 12. In practice, however, dispensing device 16 can have an overall shape and dimension to complement the shape of the mold article.

Figure 3:
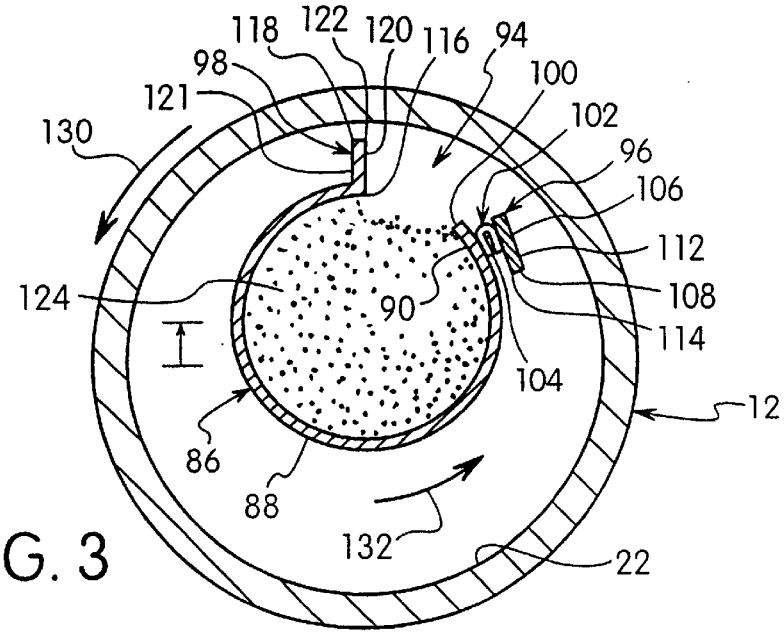
FIG. 3 is a cross-sectional end view showing the rotating mold body and the trough inserted in the mold body where the trough contains the particles of refractory material.

Dispensing device 16 includes a generally cylindrical shaped trough 86 having an outer surface 88 and an inner surface 90 as shown in FIG. 3. Trough 86 is closed at each axial end by end walls 92. An open slot 94 extends the longitudinal length of trough 86. Slot 94 has a width that is sufficient to dispense the refractory material into mold body 12 and to recover an excess amount of the refractory material before molding the desired article.

In a first embodiment of the invention shown in FIGS. 1–7, trough 86 is provided with a compacting tool 96 and a contouring tool 98. Compacting tool 96 is coupled to outer surface 88 of trough 86 adjacent a first edge 100 of open slot 94. In one embodiment of the invention as illustrated, compacting tool 96 is spaced a slight distance from first edge 100 of open slot 94.

Compacting tool 96 in the embodiment of FIGS. 1–7 is coupled to a hinge assembly 102 for pivotal movement with respect to trough 86. Preferably, compacting tool 96 is pivotable between a retracted, inoperable position as shown in FIG. 3 and an operating position shown in FIG. 4. Hinge assembly 102 generally has a first leg 104 coupled to outer surface 88 of trough 86 and second leg 106 coupled to compacting tool 96. A suitable actuator is coupled to compacting tool 96 to selectively pivot compacting tool 96 between the operating position and the retracted position and to lock compacting tool 96 in the selected position.

Figure 3A:
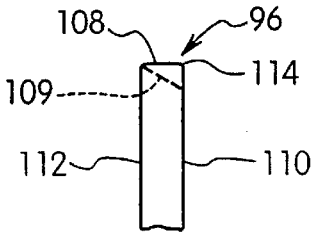
FIG. 3A is a partial side view of the plowing and compacting tool in one embodiment of the invention.

Preferably, compacting tool 96 has a substantially planar configuration having a length extending the full length of the finished mold lining and the length of trough 86. As shown in FIG. 3A, compacting tool 96 has an outer edge 108 for plowing a layer of refractory material. Preferably, compacting tool 96 has a height so that outer edge 108 is spaced radially from outer surface 88 of trough 86 a distance sufficient to plow the refractory material as discussed hereinafter in greater detail. Outer edge 108 has a width to contact the particles of refractory material with a plowing action to physically move, redistribute and compact the particles rather than a simple shearing or scraping action.

Figure 3B:
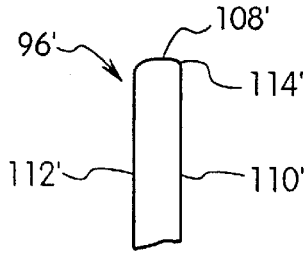
FIG. 3B is a side view of the plowing and compacting tool in a second embodiment of the invention.

Compacting tool 96 has a leading face 110 and a trailing face 112 that faces slot 94. A parting edge 114 is formed at the junction of leading face 110 at outer edge 108. Outer edge 108 can be perpendicular to leading face 110 or inclined as indicated by phantom line 109. Outer edge 108 in the embodiment shown in FIG. 3A is substantially flat and has a sufficient width to compact the refractory material as the layer of dry binderless refractory material is moved across the edge of tool 96. In an alternative embodiment shown in FIG. 3B, compacting tool 96' has a rounded or curved outer edge 108'.

In preferred embodiments, contouring tool 98 is fixed to outer surface 88 of trough 86 adjacent a second edge 116 of slot 94 and extends radially outward from trough 86. Contouring tool 98 has a generally planar shape with an outer edge 118, a leading face 120 and a trailing face 121. For purposes of illustration, outer edge 118 is substantially straight and forms a straight cylindrical molding surface in the mold lining. In practice, outer edge 118 is shaped appropriately to form the desired shape of the mold lining and the finished molded article. For example, annular ridges or recesses can be provided in outer edge 118 of contouring tool 98 to shape the lining.

In the method of the invention, a compacted mold lining is formed on inner surface 22 of mold body 12 to define the shape of the molded article. The mold lining is formed from dry, binderless particulate refractory material suitable for use in molding metal articles. In preferred embodiments, the refractory lining material is a zircon flour. The zircon flour is produced from a milled zircon sand in a crushing and grinding operation. The milling process crushes the large, round grains of the zircon sand into small angular shaped particles of zircon flour. Preferably, the zircon flour is milled to a particle size such that about 78.9% by weight pass through a 400 mesh screen and has a particle size of about 38 microns or less. It is desirable to have the particles of the refractory material milled to small angular shaped particles. The small angular shaped particles enable the particles to interlock together when compacted and the small voids between the particles not being interconnected. The interlocking particles produce a substantially air impervious layer. Small voids formed in the layer are isolated from one another surrounded by an air impervious matrix of interlocking particles.

In the method of the invention, an amount of the refractory material 124 is placed in trough 86 with slot 94 facing upwardly. Generally, about 150% by weight of the expected amount of the refractory material needed to form the mold lining is added to trough 86. The thickness of the mold lining can vary depending on the thickness and shape of the article being molded. Mold body 12 is assembled with end rings 30 attached thereto and mounted on rotating device 14. In the embodiment illustrated, mold body 12 is positioned on drive rollers 26 for rotating mold body 12 at a rotating speed suitable for centrifugal casting as known in the art. The speed of rotation will vary depending on the dimensions of mold body 12 and the article being molded. Preferably, mold body 12 is rotated at a speed to enable the particles of refractory material to adhere to the inner surface by centrifugal force without the particles bouncing out or being thrown from the mold body.

Dispensing device 16 with the refractory material 124 contained in trough 86 is moved along track 66 to insert trough 86 within mold body 12. Trunion 68 supporting trough 86 has an outer end 126 with a thrust bearing 128 as shown in FIG. 1. Carriage 62 is moved toward supporting device 14 to engage thrust bearing 128 with stationary bearing 52. Stationary bearing 52 supports the outer end of trunion 68 while trough 86 is positioned within mold body 12.

Figure 4:
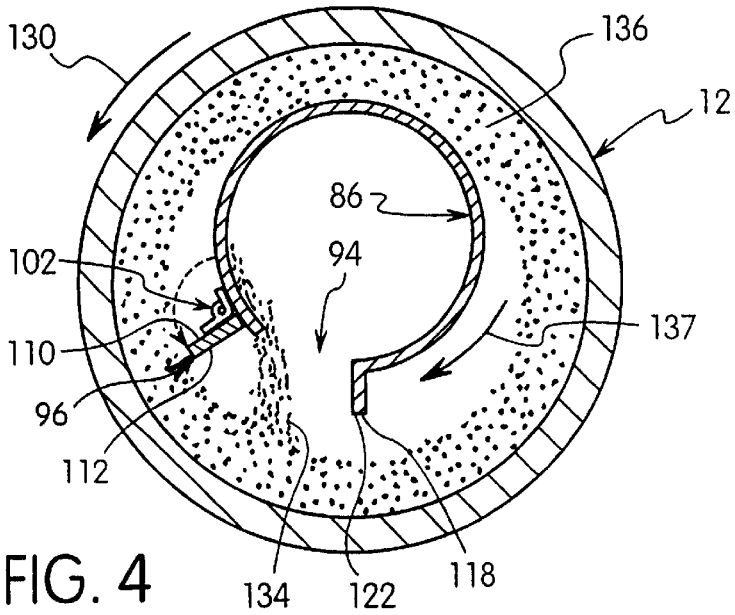
FIG. 4 is a cross-sectional view of the rotating mold showing the trough in an inverted position after dispensing and distributing the refractory material on the inner surface of the mold body.

Once trough 86 is positioned within mold body 12 and compacting tool 96 is in the retracted position as shown in FIG. 3, trough 86 is moved to an operating position. As shown in FIG. 3, trunion 68 of trough 86 is raised to an off center position from the axis of rotation of mold body 12 when in the operating position. Mold body 12 is rotated in a counter-clockwise direction as indicated by arrow 130 of FIG. 3 at a speed to generate sufficient centrifugal force to cause the particles of refractory material 124 to adhere to inner surface 22 of rotating mold body 12. Trough 86 is rotated in a clockwise direction indicated by arrow 137 about the axis of trunion 68 while trough 86 is vibrated to dispense a thin stream 134 of particles of refractory material 124 by gravity onto inner surface 22 of mold body 12 as shown in FIG. 4. Trough 86 is rotated slowly clockwise about a one-half turn to the position of FIG. 4 so that layer 136 of refractory material 124 is formed. Preferably, trough 86 is rotated and vibrated so that a thin stream of particles of refractory material forms a substantially uniform layer on inner surface 22 of mold body 12. Layer 136 is formed as a loosely formed layer that is held in place by the centrifugal force.

After refractory material 124 is dispensed and forms a loosely packed layer 136, compacting tool 96 is pivoted to the compacting position and locked in place as shown in FIG. 4. Trough 86 is then rotated to the position of FIG. 5 where outer edge 108 and parting edge 114 of compacting tool 96 are closest to inner surface 22 of mold body 12. In a preferred embodiment, trough 86 is rotated in a counter-clockwise direction as indicated by arrow 138 of FIG. 5.

Figure 5:
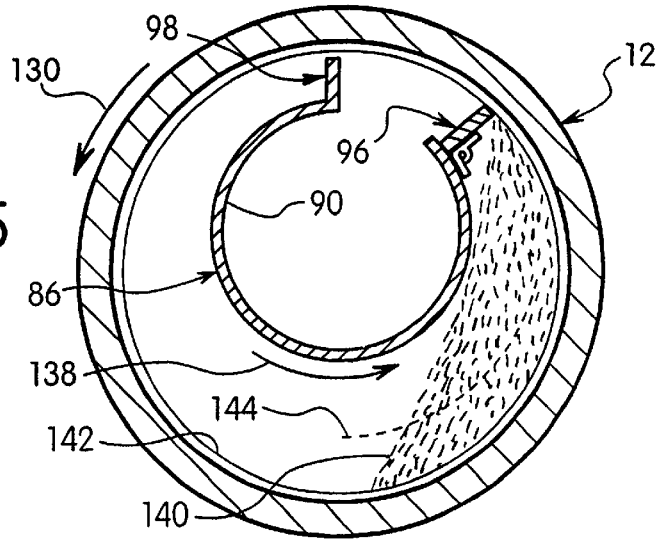
FIG. 5 is a cross-sectional view of the mold body showing the trough in a first position where a plowing and compacting tool redistributes and compacts the particles of refractory material on the inner surface of the mold body.

Referring to FIG. 5, the center axis of trough 86 is positioned so that compacting tool rotating counterclockwise penetrates into the loosely compacted layer 136 initially formed by dispersing the particles of refractory material into the rotating mold body. Parting edge 114 of compacting tool 96 displaces particles on the surface of the layer 136 and deflects the particles in a stream 140 back toward inner surface 22 of mold body 12 where the particles reform the loosely packed layer. Simultaneously, outer edge 108 of compacting tool 96 plows the particles radially outwardly toward inner surface 22 of mold body 12 to form a compacted layer 142. Preferably, outer edge 108 has a width to provide a plowing action to mechanically move and redistribute the particles while the particles are subjected to the force of inertia and centrifugal force by the rotating mold body. The position of trough 86 and compacting tool 96 form an angle between outer edge 108 and the direction of travel of the layer 136 to provide the plowing action rather than a simple shearing action shown by phantom line 144 indicating the line of travel of outer edge 108 in FIG. 5.

The density and degree of compaction of the particles forming compacted layer 142 depend in part on the rotational speed of mold body 12, the width of outer edge 108 of compacting tool 96 and the angle at which outer edge 108 contacts the particles. It has been found that rotating mold body 12 at a speed to produce 50 to 100 gravities within the mold combined with the plowing action of compacting tool 96 move and redistribute the particles to form a compacted layer that is substantially impervious to air and has a density that is greater than that obtained by centrifugal force alone.

The dense packing of the refractory particles eliminates excess air from the lining. The resulting compacted layer is formed from interlocked particles with small voids between the particles being separated from each other so that the air in the voids is not interconnected. The small voids are surrounded by interlocking particles that form an air impervious layer around the voids. The angular shape of the refractory particles enable the particles to interlock and seal to form a stable, self-supporting matrix when the particles are physically compacted by the compacting tool.

It has been found that the inertia of rotation combined with centrifugal force produced by the rotation of the mold is able to densify the particles, but centrifugal force by itself does not compact the particles to cause the particles to interlock. It has been found that particles are interlocked and form a stable molding lining with substantially no soft areas that can retain its shape after the mold body is stopped. The air impervious matrix of interlocking particles substantially prevents air from entering the voids, which prevents the particles from moving because of atmospheric pressure. The sealed voids produce a suction-like effect, which retains the particles in place. If the particles surrounding the void are moved by physical force increasing the volume of the void, the air pressure drops, and a partial vacuum is created. Air cannot enter the void and eliminate the partial vacuum, because the thousands of particles surrounding the void will not let the air in. This phenomenon is referred to as air seal bonding.

After the mold body is stopped, a portion of the compacted mold lining can be carved out without disturbing the remaining portion of the mold lining. The ability to carve out a portion from the mold lining, and to successfully pour molten metal into the spinning mold without distorting the lining, is believed to be the result of the interlocking particles and discontinuous voids between the particles. It is further believed that the small angular particle size enables the formation of small voids between the particles that are discontinuous and not interconnected with adjacent voids. This results in an air impervious compacted layer of interlocking particles that is held in place by atmospheric pressure and remains stable until air is able to enter the voids. Once air is able to enter the voids, such as by mechanically disturbing the mold lining, the particles are released.

Figure 6:
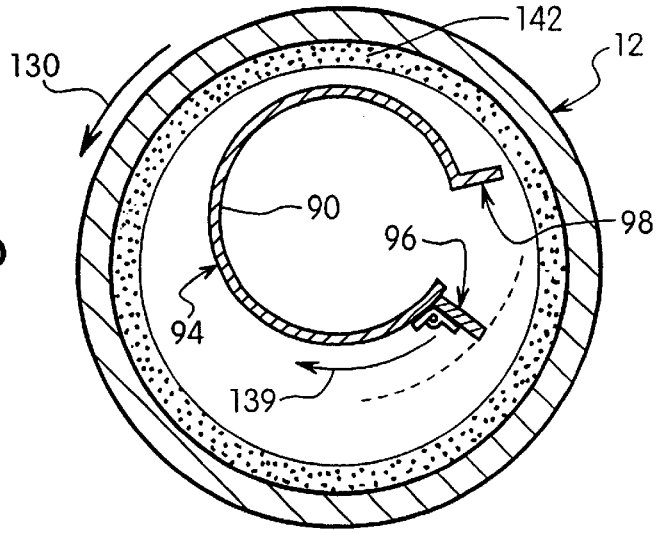
FIG. 6 is a cross-sectional view of the rotating mold body showing the trough in a position for compacting the particles of refractory material.

Referring again to FIG. 5, the position of compacting tool 96 forms the compacted layer 142 and a layer 144 of loosely compacted particles that have been dislodged by parting edge 114 of compacting tool 96. Trough 86 is gradually rotated in a clockwise direction indicated by arrow 139 to the position of FIG. 6. As shown in FIG. 6, outer edge 108 is spaced further from inner surface 22 of mold body 12 and forms a steeper angle with respect to inner surface 22 of mold body 12 than when in the position of FIG. 5. The gradual rotation of trough 86 increases the thickness of the compacted layer 142. Trough 86 is rotated in the clockwise direction until compacting tool 96 moves away from inner surface 22 of mold body 12 and no longer contacts the compacted lining 142.

Figure 7:
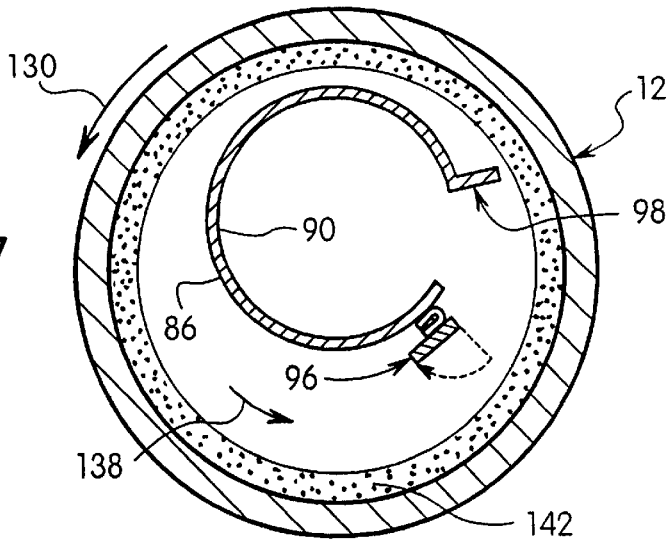
FIG. 7 is a cross-sectional view of the mold showing the trough in a position after compacting with the plowing tool folded inward.
Figure 8:
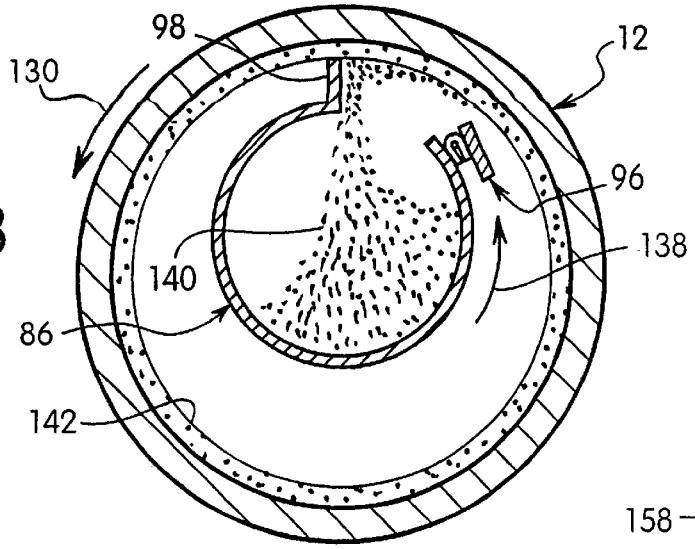
FIG. 8 is a cross-sectional view of the mold showing the trough in a position where a contouring tool contours the lining of refractory material to a desired shape and returns excess refractory material into the trough.

After the particles of refractory material are compacted to form the compacted mold lining 142, compacting tool 96 is folded while trough 86 is still inverted to the retracted position shown in FIG. 7. In one embodiment, the position of trough 86 can be moved in an upward direction to the contouring position while still inverted with respect to mold body 12 shown in FIG. 8. Trough 86 is then rotated gradually in a counterclockwise direction indicated by arrow 138 until contouring tool 98 contacts the compacted layer 142 of refractory material and removes the outermost portion of the compacted layer as shown in FIG. 8. Trough 86 is rotated to move the outer edge 118 of contouring tool 98 toward inner surface 22 until the desired thickness and shape of the compacted layer 142 is obtained. As shown in FIG. 8, the particles of refractory material removed by contouring tool 98 are directed into trough 86.

After the desired shape of the compacted layer 142 is obtained, trough 86 and contouring tool 98 are lowered and moved away from the compacted layer 142 and removed from mold body 12. Thereafter, molten metal is applied to the contoured layer to form the molded article, which then can be removed from the mold body 12 by methods known in the art. Examples of suitable casting processes are disclosed in U.S. Pat. Nos. 4,124,056 and 4,260,009 to Noble.

It has been found that compacting the small particles by physical or mechanical force in combination with the centrifugal force produces a smooth surface that is impervious to molten metal during casting and impervious to air. The plowing tool of the invention contacts the moving surface of the refractory material in a manner to compact the particles with sufficient force to cause the angular shaped particles to interlock and form the stable layer. The contouring tool is able to remove the outer portion of the compacted layer and form a contoured surface that is smoother than contouring a layer of dry particulate refractory material that has been densified by centrifugal force alone. In one embodiment, the refractory material is compacted and the rotation of the mold stopped. The compacted layer is then shaped or contoured with a suitable tool. The mold is again rotated and the metal cast onto the surface without distorting the lining.

Figure 9:
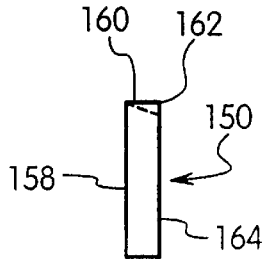
FIG. 9 is a side view of the combination compacting and plowing tool in a second embodiment of the invention.
Figure 10:
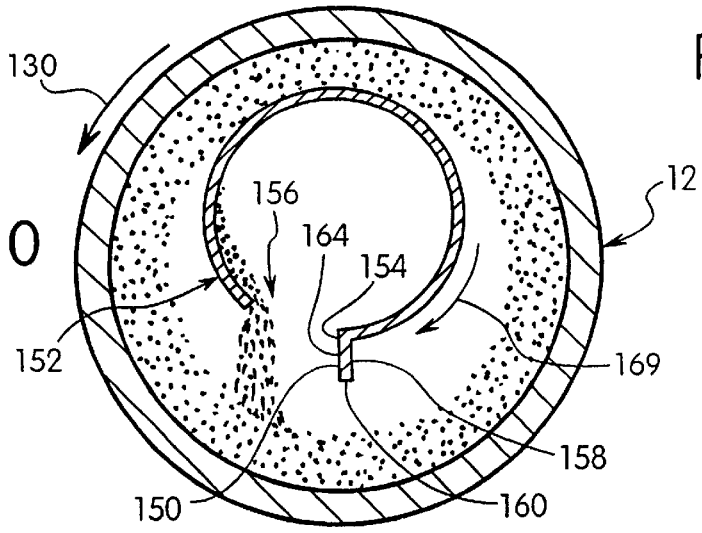
FIG. 10 is a cross-sectional view of FIG. 9 showing a trough in a second embodiment having a single plowing and contouring tool where the trough is dispensing the refractory particles onto the mold surface.
Figure 11:
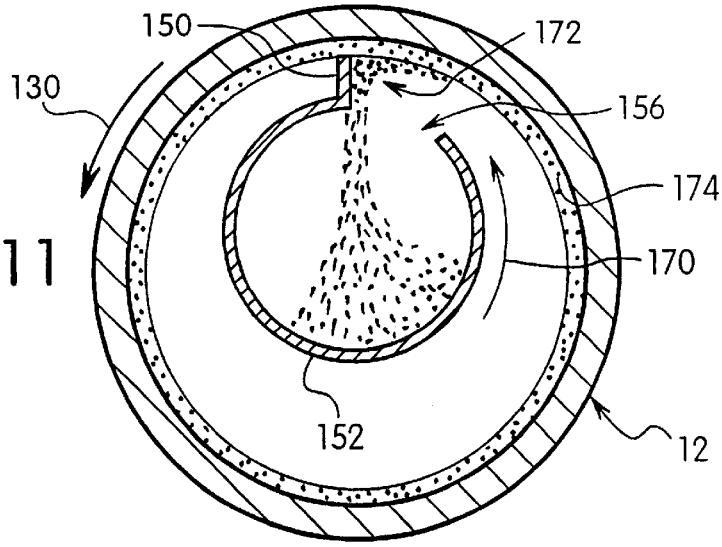
FIG. 11 is a cross-sectional view of the trough of FIG. 9 showing the tool in a compacting and shaping position.

Embodiment of FIGS. 9–11

In a further embodiment shown in FIGS. 9–11 of the invention, a single combination compacting and contouring tool 150 is coupled to a trough 152. Trough 152 is otherwise substantially the same as trough 86 of the embodiment of FIGS. 1–8 and not discussed here in detail.

Compacting and contouring tool 150 includes a base 154 that is coupled to trough 152 adjacent a slot 156 in trough 152. A body portion 158 extends outward from base 154 to an outer edge 160. A parting edge 162 extends on the leading face 164 of body portion 158 at outer edge 160. Outer edge 160 has a width sufficient to plow and compact the particles of refractory material as in the embodiment of FIGS. 1–8. This single tool is used when the desired contour is not severe.

Referring to FIGS. 9–11, trough 152 is inserted axially into a mold body 12 in a manner similar to the embodiment of FIGS. 1–7. Trough 152 containing a dry, binderless particulate refractory material is raised to the operating position similar to the embodiment of FIGS. 3–8 and rotated clockwise indicated by arrow 169 to disperse the refractory material onto the inner surface of rotating mold body 12 and to form a loosely packed layer as shown in FIG. 10. Trough 152 is then rotated gradually in a counter-clockwise direction indicated by arrow 170. As shown in FIG. 11, the counter-clockwise rotation brings outer edge 160 gradually closer toward the layer 172 of refractory material where the path of the rotating outer edge 160 contacts the refractory material. Contact is initially made with the refractory material where outer edge 160 forms a steep angle with respect to the direction of movement of the refractory material on the inner surface of the mold body 12. The angle formed between outer edge 160 and the layer 172 of refractory material plows and compacts the particles toward the inner wall of mold body 12 and forms a hard compacted layer 174, which is impervious to air.

As shown in FIG. 11, as trough 152 is rotated counterclockwise, the particles of refractory material are compacted further and the excess particles are removed by parting edge 162 and returned to trough 152. Tool 150 has an outer edge 160 with sufficient width, to plow and compact the particles, producing a smooth molding surface that cannot be obtained by densifying the particles by centrifugal force alone. Once the desired degree of compaction and thickness of compacted layer 174 is obtained, trough 152 is lowered and moved away from the inner surface of mold body 12. Trough 152 is then removed from the mold and the molten metal introduced to cast the desired article.

Figure 12:
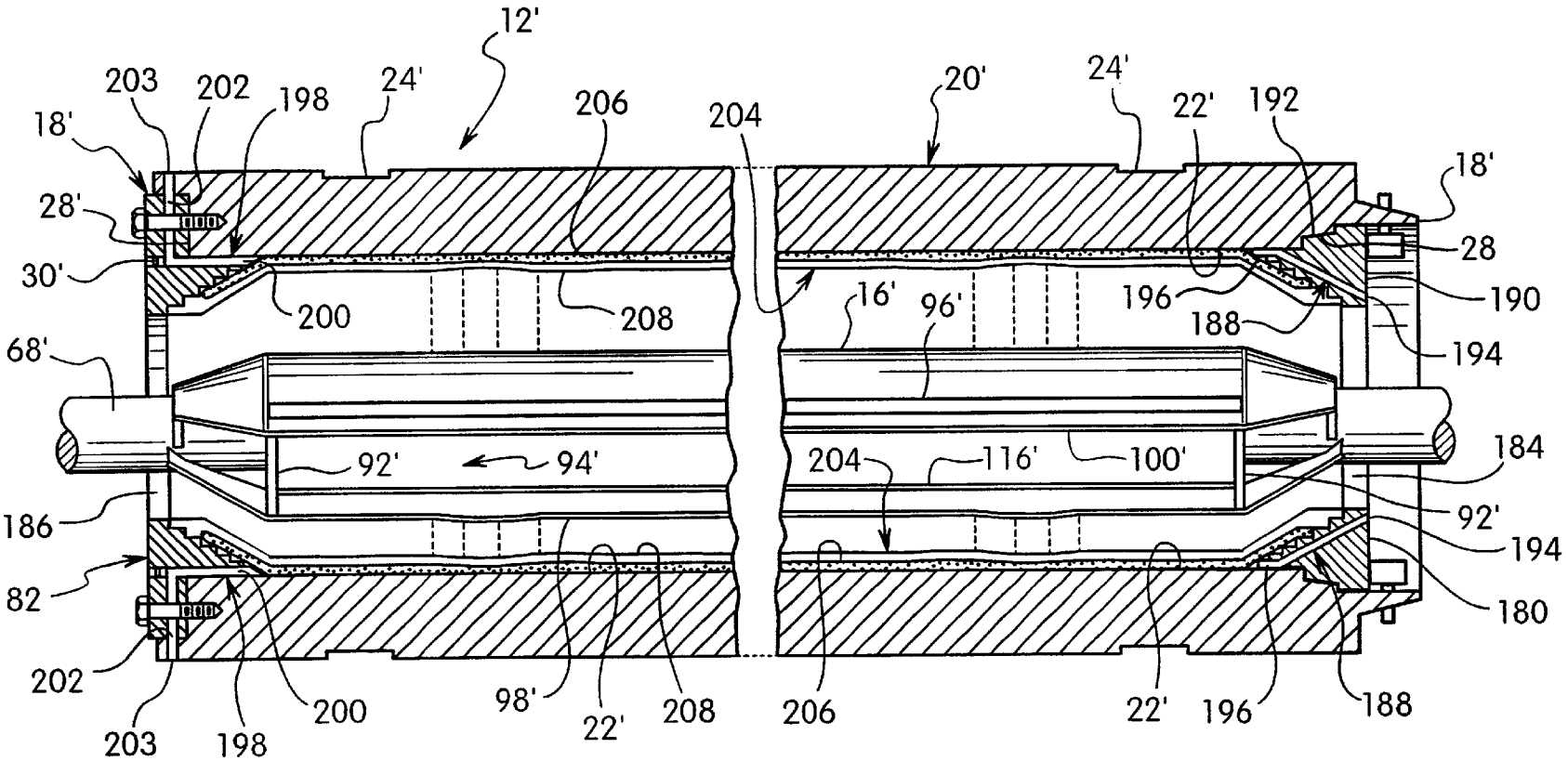
FIG. 12 is a cross-sectional side view of the centrifugal mold and dispensing trough showing dual mold linings and lining air venting system in one embodiment of the invention.

Embodiment of FIG. 12

In another embodiment of the invention, a mold 12' is provided for cooling the mold surface and molten metal during the casting process. Mold 12' of FIG. 12 is similar to mold 12 of the previous embodiment so that identical components are identified by the same reference number with the addition of a prime.

Referring to FIG. 12, mold 12' includes a cylindrical wall 20' and end caps 180 and 182 with axial openings 184 and 186, respectively. End cap 180 includes air inlet channels 188 extending between an outer axial face 190 and an inner axial face 192. Each channel 188 has a first open end 194 at outer face 190 adjacent axial opening 184. Each channel 188 also has a second open end 196 at inner axial face 192 at an outer radially facing edge of end cap 180. As shown in FIG. 12, second open end 196 of channel 188 is adjacent inner surface 22' of mold wall 20'. Channels 188 are dimensioned to supply a flow of air into mold 12' during rotation of mold 12' and casting of the metal as discussed hereinafter in greater detail. Typically, four air inlet channels 188 are provided in end cap 180, although the actual number can vary as needed. Preferably channels 188 are spaced uniformly around mold 12' to promote uniform cooling.

End cap 182, as shown in FIG. 12, has several air channels 198 with a first open end 200 positioned at inner surface 22' of mold 12' and a second open end 202 at a radially facing edge of end cap 182. Mold wall 20' has radial channels 203 communicating with second open ends 202 of channels 198 in end cap 182 to direct air radially outward. In another embodiment, the end cap includes an air passage terminating at a radial face that is open to the atmosphere. In this manner, radial channels 203 in mold wall 20' are not necessary.

As shown in FIG. 12, channels 188 are oriented in a generally radial direction with respect to an axis of rotation of mold 12'. First open end 194 of each channel 188 is spaced radially inward with respect to second open end 196 so that rotation of mold 12' produces a centrifugal pumping action to produce a flow of air through channels 188 to mold surface 22' of mold 12'. Since first open end 194 of each channel 188 is open to outside air, fresh air is continually supplied to inner surface 22'. In a similar manner, channels 198 extend in a generally radial direction where second open end 202 is spaced radially outward with respect to first open end 200. Rotation of mold 12' produces an air flow from mold surface 22' outward through channel 198 and channel 203. In one preferred embodiment, four air outlet channels 198 are spaced around mold 12'.

In this embodiment of the invention, a mold lining 204 is formed on inner wall 22' by distributing, compacting and shaping refractory materials. Mold lining 204 includes a primary porous layer 206 of a first refractory material and a secondary substantially air impervious facing layer 208 of a second refractory material. It has been found that under certain conditions, a mold lining formed from an air impervious single layer of a refractory material results in a slow cooling rate that can hinder the commercial viability of the casting process. A slow cooling rate increases the manufacturing cost and can reduce the quality of the finished product. In cast iron cylinder liners, where graphite size is very important, slow cooling rates can cause an overgrowth of graphite flakes, which also weakens the strength of the iron.

A mold lining of a compacted facing layer that is substantially impervious to air requires a particulate refractory material containing at least about 50% by weight of small angular particles, such as a milled refractory flour. A large number of small particles produce a large number of discontinuous voids in the resulting compacted mold lining. The discontinuous, closed voids provide a thermal insulating effect in the mold lining, thereby reducing the conduction of heat through the mold lining and reducing the cooling rate of the casting. In contrast, a lining formed from larger refractory particles conducts heat more rapidly from the casting since heat passes through the particles at a faster rate than through the discontinuous voids. As the proportion of small particles in the mold lining increases, the number of discontinuous voids increases with a corresponding decrease in the rate of heat transfer.

In this embodiment of the invention, a first porous refractory layer 206 is formed in mold 12' in communication with air inlet channels 188 and air outlet channels 198. Channels 188 and 198 are oriented such that rotation of mold 12' functions as a centrifugal pump to draw fresh air into channel 188 where it is directed to first porous layer 206. The air is carried in a substantially longitudinal direction with respect to porous layer 206 to channels 198 to provide a cooling effect to porous layer 206 and air impervious layer 208 in lining 204. The air is then withdrawn from porous layer 206 and directed through channels 198 where the air is discharged. The rotation of mold 12' provides a continuous air flow and cooling effect to mold lining 204. The volume of air that can be passed through the porous layer 206 can be controlled by varying the radial distance between the inlet end and outlet end of the channels, varying the internal volume of the channels, and varying the speed of rotation of the mold.

The first primary lining layer 206 is formed from a dry, binderless particulate refractory material having a particle size that provides a high permeability to gas flow and high thermal conductivity. In embodiments of the invention, a particulate refractory material having a high gas permeability is obtained from materials having a particle size distribution with at least 25%, and preferably at least 40% by weight of the particles with a maximum dimension of greater than 212 microns. An optimum combination of thermal conductivity and permeability to gas flow through the resulting lining layer is obtained when the larger particles having a maximum dimension exceeding 212 microns, and preferably 300 microns, are in particle-to-particle contact throughout the thickness of the lining.

The porous first lining is preferably formed from a particulate refractory material having at least 20% by weight angular particles. In a preferred embodiment, the porous layer is made from crushed graphite having essentially all of the particles being angular particles. A commercially available particulate graphite is obtained by crushing used graphite furnace electrodes having the following particle size distribution:

| Sieve Openings | | |
|---|---|---|
| U.S. Mesh | (Microns) | wt % |
| 30 | 600 | 2.2 |
| 40 | 425 | 20.1 |
| 50 | 300 | 21.1 |
| 70 | 212 | 17.3 |
| 100 | 150 | 13.0 |
| 140 | 106 | 10.3 |
| 200 | 75 | 8.2 |
| 270 | 53 | 0.6 |
| pan | — | 7.2 |

The particles are angular and have an angle of repose of 37.5° and a void volume of 44% determined by subjecting the sample to 100 shocks with a conventional laboratory compactor and then determining the volume of water which the compacted sample will accept and retain.

The facing layer 208 is preferably formed from a dry, binderless refractory material such as the milled zircon flour of the previous embodiment. Examples of the particulate refractory material for forming the porous layer and the particulate refractory material for forming the air impervious facing layer is disclosed in U.S. Pat. No. 4,632,168 to Noble, which is hereby incorporated by reference in its entirety.

The mold lining 204 of the embodiment of FIG. 12 is produced in a manner similar to the previous embodiment. An amount of the first refractory particulate material capable of forming a porous primary lining is supplied in trough 16'. Trough 16' is inserted into mold 12' while mold 12' is rotated at a speed sufficient to distribute the particles in mold 12'. In one embodiment, mold 12' is rotated at about 500 RPM. Trough 16' is rotated to dispense the refractory particles so that the particles are distributed onto mold surface 22'. Trough 16' is then rotated as in the previous embodiments so that compacting tool 96' redistributes and compacts the particles to form first lining layer 206. In preferred embodiments, compacting tool 96' is retracted and trough 16' is rotated so that contouring tool 98' makes contact with layer 206 and shapes the porous layer 206.

After the porous layer 206 is shaped, trough 16' is removed from mold 12'. Any of the recovered first refractory particles are removed from trough 16' and an amount of a second refractory particulate material is added. Preferably, the second particulate refractory material is capable of forming an air impervious lining or facing layer of interlocked particles as in the previous embodiment. The trough 16' is inserted into mold 12' and second particulate material is dispersed, redistributed, compacted and shaped. After compacting and shaping innermost layer 208, trough 16' is removed from mold 12'. In one embodiment when the surface of the cast article defined by the facing layer is to be a rough surface, facing layer 208 is formed from a binderless refractory particulate material having a particle size distribution of 50% by weight or less having a maximum dimension of greater than 150 microns. The refractory material has a content of sharp angular particles of at least 40% by weight. In another embodiment, when the surface of the cast article defined by the facing layer is to be smooth, at least 50% by weight of the angular particles have a maximum dimension of 75 microns or less.

Mold 12' is rotated at a sufficient speed for casting a molten metal and an amount of molten metal is introduced into the mold 12'. The compacted and shaped lining 204 is formed from the porous primary layer 206 and the air impermeable innermost facing layer 208 on the active mold surface 22'. The rotational speed of mold 12' draws fresh air in through channel 188 and through porous layer 206 to channel 198 where the air is discharged. The flow of air through porous layer 206 cools facing layer 208 to assist in cooling the molded metal article at a sufficient rate.

In a still further embodiment, a removable sleeve made of a porous material is placed in mold 12' to form layer 206. A particulate binderless refractory material capable of forming an air impermeable facing layer is introduced onto the sleeve, redistributed, compacted and shaped to form the facing layer 208. A molten metal is then introduced into the mold while rotating to mold the metal and draw cooling air through the porous sleeve to cool the metal. The sleeve can be made from a ceramic, metal or other porous material that is able to support the air impervious facing layer of the refractory particles and the casting metal and provide adequate air flow through the sleeve. In still further embodiments, a sleeve made of metal, ceramic or other refractory materials having channels or grooves formed therein can be inserted into the mold in a manner such that the grooves or channels communicate with the inlet and outlet channels in the mold to direct cooling air through the sleeve when the mold is rotated.

In other embodiments of the invention, an air permeable mold lining is in the form of a pre-formed air permeable sleeve. The sleeve has an outer dimension and length to fit in mold 12'. An air impermeable mold facing layer can be formed on the mold lining from a non-compacted refractory material.

In one embodiment, the pre-formed porous sleeve is pre-heated to a suitable temperature by a heat source, such as an oven. With the pre-heated pre-formed sleeve standing on end, a fine grain shell sand containing a heat activated binding agent is placed in the sleeve to completely fill the internal cavity of the sleeve. The shell sand and binding agent are standard materials as known in the art of centrifugal casting of metal pipe. The temperature of the pre-heated porous sleeve activates a catalyst in the binding agent in the shell sand to form a rigid air impermeable matrix on the surface of the sleeve that functions as a mold facing layer for casting molten metal.

The thickness of the resulting facing layer formed by the rigid shell sand matrix is determined by the temperature of the pre-formed porous sleeve and the length of time that the shell sand contacts the pre-heated sleeve. After a desired thickness of the facing layer is formed, the remaining excess shell sand is poured from the sleeve. The result is an air impermeable facing layer formed from the shell sand on the inner face of the pre-formed, porous sleeve.

The pre-formed sleeve with the air impervious facing layer is inserted into the mold and the molten metal is introduced to cast the desired article. The molten metal can be cast immediately onto the mold facing layer. Air is drawn through the inlets of the mold and through the porous sleeve to provide an effective cooling rate during the casting of the metal. The resulting casting and the sleeve are then removed from the mold as a single unit. The porous sleeve is stripped from the casting and reused for a subsequent casting.

In another embodiment, the pre-formed porous sleeve while standing on end is filled with a wet cement slurry containing a small amount of water. The sleeve is then inverted and the cement poured from the sleeve. The cement adhering to the inner surface of the sleeve is dried slowly and thoroughly to form an air impervious mold facing layer on the porous sleeve. The thickness of the facing layer is determined primarily by the viscosity of the cement slurry. The more viscous the cement slurry, the thicker the layer of cement remaining on the inner surface of the sleeve.

The pre-formed porous sleeve with the cement facing layer is placed in the mold and the molten metal is cast onto the cement lining. Cooling air is drawn through the porous sleeve as in the previous embodiment to cool the molded metal article. The casting and the sleeve are removed from the mold as a single unit. The porous sleeve is stripped form the casting and reused.

In the illustrated embodiment, air inlet channels 188 and air outlet channels 198 are positioned at the opposite axial ends of mold 12'. In other embodiments, inlet channels and outlet channels can be formed at each end of mold 12'. The outlet channels can also be formed along the length of mold 12' and to extend in a radially outward direction to draw cooling air through porous layer 206, and out through the mold wall.

While various embodiments have been chosen to illustrate the invention, it will be understood by those skilled in the art that various modifications and additions can be made without departing from the scope of the invention as defined in the appended claims.

What is claimed is:

1. A method for the centrifugal casting of metal articles, said method comprising the steps of providing a rotary mold assembly having a rotating cylindrical mold having an inner mold surface with a longitudinal length and a generally open axial end and an elongated trough containing a dry, binderless refractory material, said trough having a longitudinal opening with a leading edge and trailing edge with respect to a direction of rotation of said mold, and a plowing device coupled to said trough at said leading edge, dispensing a predetermined amount of particles of said dry, binderless milled refractory material onto said inner mold surface while continuously rotating said cylindrical mold at a sufficient speed to distribute said refractory material along said inner mold surface and form a loose layer of said refractory material on said inner mold surface, moving said plowing device toward said inner mold surface and penetrating said loose layer of said refractory material with said plowing device to a predetermined depth without removing said particles from said mold surface while continuously rotating said cylindrical mold and physically redistributing, compacting and densifying said particles of said layer of said refractory material against said mold surface away from said plowing device and said trough and forming a substantially air impervious mold lining; and further comprising a contouring tool for shaping said mold lining, said contouring device being coupled to said trailing edge of said opening of said trough, said method further comprising moving said plowing device to said inoperable position and contacting said contouring device with said compacted mold lining and removing a portion of said particles to form a predetermined contour of said mold lining removing said trough from said mold, rotating said mold at a speed sufficient to cast a molten metal against said inner surface of said mold, and introducing a molten metal onto said substantially air impervious mold lining and molding said metal.

2. The method of claim 1, comprising contacting said layer of refractory material with said plowing device at an angle to expel a substantial portion of air between said particles and form said air impervious mold lining of interlocked particles without soft spots.

3. The method of claim 2, wherein said air impervious mold lining is compacted to seal voids between said particles which are not interconnected with voids between adjacent particles.

4. The method of claim 2, comprising redistributing said particles of said refractory material to a predetermined depth in said layer to compact said particles substantially the entire depth of said layer.

5. The method of claim 1, wherein said plowing device includes a plowing tool having a working surface, said method comprising contacting said particles with said working surface at an angle to plow and compact said particles toward said inner mold surface and densify said layer.

6. The method of claim 5, wherein said plowing tool has a substantially flat end portion, said method comprising contacting said layer with said flat end portion oriented at an angle with respect to a direction of rotation of said mold to compact said layer.

7. The method of claim 5, wherein said working surface of said plowing tool has a substantially curved profile and said method comprises contacting said particles with said working surface.

8. The method of claim 1, comprising contacting said layer with said plowing device whereby particles of said refractory material that are dislodged from said layer are plowed and compacted back toward said inner mold surface.

9. The method of claim 1, comprising inserting said trough into said cylindrical mold, and rotating said trough to dispense said particles onto said inner mold surface.

10. The method of claim 9, wherein said plowing device is movable with respect to said trough from an operable position to an inoperable position.

11. The method of claim 1, wherein said contouring tool has a leading face and a trailing face, a first end coupled to said trough and a second end spaced outward from said trough, said second end having a parting edge on said leading face, said method comprising contacting said parting edge with said compacted mold lining to remove said particles.

12. The method of claim 11, wherein said parting edge is spaced from said trough a first distance and said second end of said plowing device is spaced a second distance from said trough when in said operable position that is greater than said first distance.

13. The method of claim 11, wherein said second end of said contouring tool is spaced a distance from said trough that is greater than said parting edge of said plowing device when said plowing device is in said inoperable position.

14. The method of claim 1, comprising positioning said trough whereby said contouring device returns excess particles of said refractory material into said trough through said opening.

15. The method of claim 1, comprising moving said plowing device toward said mold surface of said mold to a sufficient depth to redistribute and compact said particles of refractory material against said mold surface and form said air impermeable mold lining.

16. The method of claim 1, comprising moving said plowing device to a first position to penetrate said layer to a sufficient depth to compact a bottom portion of said layer, and gradually moving said plowing device away from said inner mold surface to a second position to compact substantially the entire depth of said layer.

17. The method of claim 1, wherein said dry binderless milled refractory material is a milled zircon flour having a particle size whereby about 78.9% by weight of said particles pass through a 400 mesh screen.

18. The method of claim 1, wherein said dry binderless milled refractory material has a particle size whereby about 78.9% by weight of said particles have a particle size of about 38 microns or less.

19. The method of claim 17, wherein at least about 50% by weight of said particles are angular particles.

20. A method for the centrifugal casting of metal articles, said method comprising the steps of providing a rotary mold assembly having a cylindrical mold having an inner mold surface with a longitudinal length and a generally open axial end, said mold having at least one air inlet for directing air to said mold surface and at least one air outlet for discharging air from said mold surface, said air outlet being spaced radially outward with respect to said air inlet, providing an air permeable primary lining on said inner mold surface, said primary lining being in communication with said air inlet and said air outlet, providing an air impermeable mold facing layer on said air permeable lining, wherein said air impermeable mold facing layer is formed by introducing a predetermined amount of particles of a dry, binderless milled second refractory material onto said primary lining while continuously rotating said cylindrical mold at a sufficient speed to distribute said refractory material along said primary lining and form a layer of said refractory material on said primary lining, and contacting said layer of said second refractory material with a plowing material with a plowing tool while continuously rotating said cylindrical mold to physically redistribute, compact and densify said particles of said layer of said second refractory material and to form said air impervious mold facing layer to predetermined dimensions, and further shaping said mold lining with a contouring tool, rotating said mold at a speed sufficient to cast a molten metal against said inner surface of said mold and to draw air in said air inlet through said air permeable mold facing layer on said mold surface and to discharge air through said air outlet, and introducing a molten metal onto said air impermeable mold facing layer and molding said metal.

21. The method of claim 20, comprising the step of rotating said cylindrical mold during said molding step at a sufficient speed to draw air from said air inlet through said air permeable primary lining to said air outlet to cool said air impermeable mold facing layer.

22. The method of claim 20, wherein said first refractory material is a particulate graphite and said second refractory material is a milled zircon flour.

23. The method of claim 20, wherein said at least one air inlet has an inlet end for receiving air and an outlet end at said inner mold surface, said outlet end being spaced radially outward from said inlet end with respect to an axis of rotation of said mold.

24. The method of claim 20, wherein said mold includes an end cap extending radially inward from said inner mold surface, said air inlet extending through said end cap, said inlet having an air inlet end and an air outlet end, said air outlet end being positioned radially outward with respect to said air inlet end and being positioned adjacent said inner mold surface.

25. The method of claim 20, wherein said at least one air outlet has an inlet end at said inner surface of said mold, and an outlet end spaced radially outward from said inlet end.

26. The method of claim 25, wherein said outlet end of said at least one air outlet is at an outer surface of said mold.

27. The method of claim 25, wherein said at least one air inlet is provided at a first axial end of said mold and said at least one air outlet is provided at a second axial end of said mold.

28. The method of claim 20, wherein said first refractory material has a particle whereby at least 40% by weight of said particles have a dimension greater than 212 microns.

29. The method of claim 28, wherein said second refractory material has a particle whereby about 78.9% by weight of said particles have a particle size of about 38 microns or less.

30. A method of casting a metal article comprising the steps of:

rotating a rotary mold having an inner mold surface with a longitudinal length and a generally open axial end, introducing an amount of particles of a dry, binderless milled refractory material into said rotating mold and distributing said refractory material by centrifugal force against said inner mold surface to form a loose layer of refractory material, positioning a plowing tool in said mold, said plowing tool having a working surface with a leading edge and a trailing edge with respect to a direction of rotation of said mold, moving said plowing tool to a first position where said working surface of said plowing tool penetrates and plows said loose layer toward said mold surface, where said working surface is at an angle such that said trailing edge penetrates said loose layer to a depth greater than said leading edge to compact and densify a bottom portion of said layer of refractory material and form a compacted densified air impervious layer having a thickness, gradually moving said plowing tool away from said mold surface to a second position spaced outwardly from said first position to increase the thickness of said compacted densified layer to compact and densify the entire depth of said layer of refractory layer to form a compacted and densified air impervious layer, contacting said air impervious layer with a contouring tool and contouring said air impervious layer by removing a portion of said refractory material from said air impervious layer, and introducing a molten metal onto said air impervious layer and molding said metal article.

31. The method of claim 30, said method comprising positioning a trough in said mold, said trough having an elongated slot with a leading edge and a trailing edge with respect to a direction of rotation of said mold, said plowing tool being coupled to said trough at said leading edge and said contouring tool being coupled to said trailing edge, said method comprising moving said trough to a plowing position whereby said plowing tool plows said refractory material away from said slot of said trough toward said inner mold surface to compact said refractory material, and thereafter moving said trough to a contouring position whereby said contouring tool removes a portion of said compacted air impervious layer and directs said removed portion into said trough.

32. The method of claim 30, comprising compacting and densifying said refractory material without removing said refractory material from said rotating mold.

33. The method of claim 30, comprising moving said plowing tool to penetrate said loose layer of refractory particles and forming said compacted air impervious layer of interlocking particles having a thickness less than a thickness of said loose layer.

34. The method of claim 33, comprising gradually moving said plowing tool away from said loose layer of refractory material to increase a thickness of said compacted and densified air impervious layer of interlocking particles.

35. The method of claim 31, wherein said working surface has a width sufficient to compact said refractory material, and wherein said method comprises moving said plowing tool toward said loose layer of refractory material, whereby said working surface penetrates said refractory material at an incline with respect to said mold surface to plow said refractory material toward said inner mold surface and compact and densify said refractory material.

36. The method of claim 35, wherein said working surface of said plowing tool is substantially perpendicular to said leading edge of said plowing tool.

37. The method of claim 35, wherein said working surface of said plowing tool is at an incline with respect to said leading edge, whereby said trailing edge is spaced outwardly from said trough a distance greater than said leading edge, said method comprising moving said plowing tool to a position where said incline of said working surface plows said refractory particles toward said mold surface and compacts and densifies said refractory particles.

38. The method of claim 35, wherein said working surface of said plowing tool has a rounded surface.

* * * * *